US010094550B2

(12) United States Patent
Chen

(10) Patent No.: US 10,094,550 B2
(45) Date of Patent: Oct. 9, 2018

(54) WATERPROOF LED DECORATIVE BULB

(71) Applicant: Dongguan City Minleon Electronics Co., Ltd., Dongguan, Guangdong (CN)

(72) Inventor: Dongchang Chen, Dongguan (CN)

(73) Assignee: Dongguan City Minleon Electronics Co., Ltd., Dongguan (CN)

( * ) Notice: Subject to any disclaimer, the term of this patent is extended or adjusted under 35 U.S.C. 154(b) by 0 days.

(21) Appl. No.: 15/402,310

(22) Filed: Jan. 10, 2017

(65) Prior Publication Data

US 2018/0156445 A1 Jun. 7, 2018

(30) Foreign Application Priority Data

Dec. 7, 2016 (CN) ..... 2016 2 1337946

(51) Int. Cl.
*F21V 31/00* (2006.01)
*F21V 3/02* (2006.01)
(Continued)

(52) U.S. Cl.
CPC ..... *F21V 31/005* (2013.01); *F21V 3/02* (2013.01); *F21V 17/12* (2013.01); *F21V 19/002* (2013.01);
(Continued)

(58) Field of Classification Search
CPC ..... F21K 9/235; F21K 9/232; F21K 9/233; F21K 9/237; F21K 9/238; F21V 31/00; F21V 31/005
See application file for complete search history.

(56) References Cited

U.S. PATENT DOCUMENTS 6,153,972 A * 11/2000 Katougi ..... H01K 1/34 313/318.02
2006/0232178 A1* 10/2006 Setzer ..... F21V 31/005 313/113

(Continued)

FOREIGN PATENT DOCUMENTS

CN 205606252 U * 9/2016

OTHER PUBLICATIONS

Lyu, LED (light-emitting diode) light bulb, Sep. 28, 2016, Patent CN205606252U; Google Patents, https://patents.google.com/patent/CN205606252U/en.*

*Primary Examiner* — Anh Mai
*Assistant Examiner* — Michael Chiang
(74) *Attorney, Agent, or Firm* — JCIPRNET

(57) ABSTRACT

A waterproof LED decorative bulb comprises a lampshade, a horizontal first circuit board, and a plurality of patch LED luminous bodies, the first circuit board is connected with a conductive pin, underneath of the conductive pin is electrically connected with a vertical second circuit board, a lower end of the second circuit board is electrically connected with a hard vertical pin-type electrode and a upward-bending conductive wire, underneath of the conductive pin is provided with a silica gel cushion, a bottom of the lampshade is provided with an outer threaded connection portion which is in threaded connection with a metal connecting base, a bottom of the silica gel cushion is fitted with an inner bottom of the metal connecting base, the pin-type electrode pierces through the silica gel cushion and extends out of a through hole at the bottom of the metal connecting base to form an extending portion.

4 Claims, 3 Drawing Sheets

(51) Int. Cl.

| | |
|---|---|
| ***F21V 17/12*** | (2006.01) |
| ***F21V 19/00*** | (2006.01) |
| ***F21V 29/85*** | (2015.01) |
| *F21Y 115/10* | (2016.01) |
| *F21W 121/00* | (2006.01) |

(52) U.S. Cl.
CPC ..... *F21V 29/85* (2015.01); *F21W 2121/00* (2013.01); *F21Y 2115/10* (2016.08)

(56) References Cited

U.S. PATENT DOCUMENTS

2012/0218748 A1* 8/2012 Conrad ..... F21V 19/0055 362/230
2016/0102853 A1* 4/2016 Fedele ..... F21V 23/004 362/382

* cited by examiner

WATERPROOF LED DECORATIVE BULB

FIELD OF THE INVENTION

The invention relates to an illuminating device, and more particularly, to a waterproof LED decorative bulb.

BACKGROUND OF THE INVENTION

For the existing LED decorative bulb, a tail electrode of a screw-on lamp holder at the tail thereof is opened with a small hole, so that a conductive pin inside is extended out, and then is connected with the tail electrode by soldering tin. For convenience in connection by soldering tin and connection reliability, this small hole has to be provided, so that the center of the tail electrode is opened with such small hole used for electric connection. However, it is because of the small hole that the waterproofness of the LED decorative bulb becomes a problem. In order to make it waterproof, the previous method is to process the small hole in the conductive pin and the tail electrode in enclosed type connection by soldering tin to achieve the object of waterproofness; however, such processing result often makes the waterproofness below the required due to the existing defects of soldering tin, as well as heat expansion and cold contraction, loosening of soldering tin and a series of factors. Therefore, it is necessary to develop a new waterproof LED decorative bulb to overcome these above deficiencies.

SUMMARY OF THE INVENTION

In order to overcome the deficiencies of the prior art, the invention aims at providing a waterproof LED decorative bulb having better waterproof efficiency, both an upper end and a lower end of which are subject to waterproofing work.

In order to solve the technical problem, the invention adopts the technical solution as follows: a waterproof LED decorative bulb, comprising a lampshade, a horizontal first circuit board horizontally placed at an inner bottom of the lampshade, and a plurality of patch LED luminous bodies arranged on the first circuit board, wherein a bottom surface of the first circuit board is connected with two hard vertical conductive pins, underneath of the two conductive pins is electrically connected with a vertically placed second circuit board, the second circuit board is provided with a patch resistor and an LED driving chip, a lower end of the second circuit board is electrically connected with two electrodes, one of the two electrodes is a hard vertical pin-type electrode and the other thereof is a upward-bending conductive wire, underneath of the conductive pin is provided with a silica gel cushion, a bottom of the lampshade is provided with an outer threaded connection portion which is in threaded connection with a metal connecting base, the first circuit board, the second circuit board and the silica gel cushion are covered and fixed by the metal connecting base between an inner bottom of the lampshade and an inner wall of the metal connecting base, a side wall and a bottom of the metal connecting base are a contact electrode respectively, a bottom of the silica gel cushion is fitted with an inner bottom of the metal connecting base, the pin-type electrode pierces through the center of the silica gel cushion and extends out of a through hole at the bottom of the metal connecting base to form an extending portion, the extending portion and a contact electrode of the metal connecting base are connected by soldering tin, the conductive wire is contacted with an inner side wall of the metal connecting base, an engagement portion between the lampshade and the outer threaded connecting portion is provided with a waterproof groove, and the waterproof groove is internally provided with a waterproof rubber gasket.

Preferably, the silica gel cushion is provided with a circular table, and an outer edge of the circular table is contacted with and compressed with the inner side wall of the metal connecting base.

Preferably, the silica gel cushion is provided with a concave bottom, and an outer edge of the concave bottom is fitted and contacted with and compressed with the inner side wall of the metal connecting base.

Preferably, the center of an upper surface of the silica gel cushion is provided with a sunken portion, and the pin-type electrode pierces through the silica gel cushion from the sunken portion.

The invention has the advantageous effects as follows: as an engagement portion between the lampshade and the outer threaded connecting portion is provided with a waterproof groove, the waterproof groove is internally provided with a waterproof rubber gasket, underneath of the second circuit board is provided with a silica gel cushion, a bottom of the lampshade is provided with an outer threaded connection portion which is in threaded connection with a metal connecting base of the bulb, the first circuit board, the second circuit board and the silica gel cushion are covered and fixed by the metal connecting base between an inner bottom of the lampshade and an inner wall of the metal connecting base, a bottom of the silica gel cushion is fitted with an inner bottom of the metal connecting base, the pin-type electrode pierces through the center of the silica gel cushion and extends out of a through hole at the bottom of the metal connecting base to form an extending portion, the extending portion and a contact electrode of the metal connecting base are connected by soldering tin, the waterproof rubber gasket and the silica gel cushion perform waterproof treatment from an upper end and a lower end of the metal connecting base respectively, so that both the upper end and the lower end of the metal connecting base are provided with a waterproof member, and all subject to waterproof treatment. In this way, the waterproof efficiency of the invention is better. In addition, the silica gel cushion also has a heat dissipation function, which can cool inside electronic elements and LED, so as to ensure and prolong the service lives thereof.

BRIEF DESCRIPTION OF THE DRAWINGS

The invention will be further described in details with reference to the drawings and the implementation manner hereinafter.

DETAILED DESCRIPTION OF THE PREFERRED EMBODIMENTS

Figure 1:
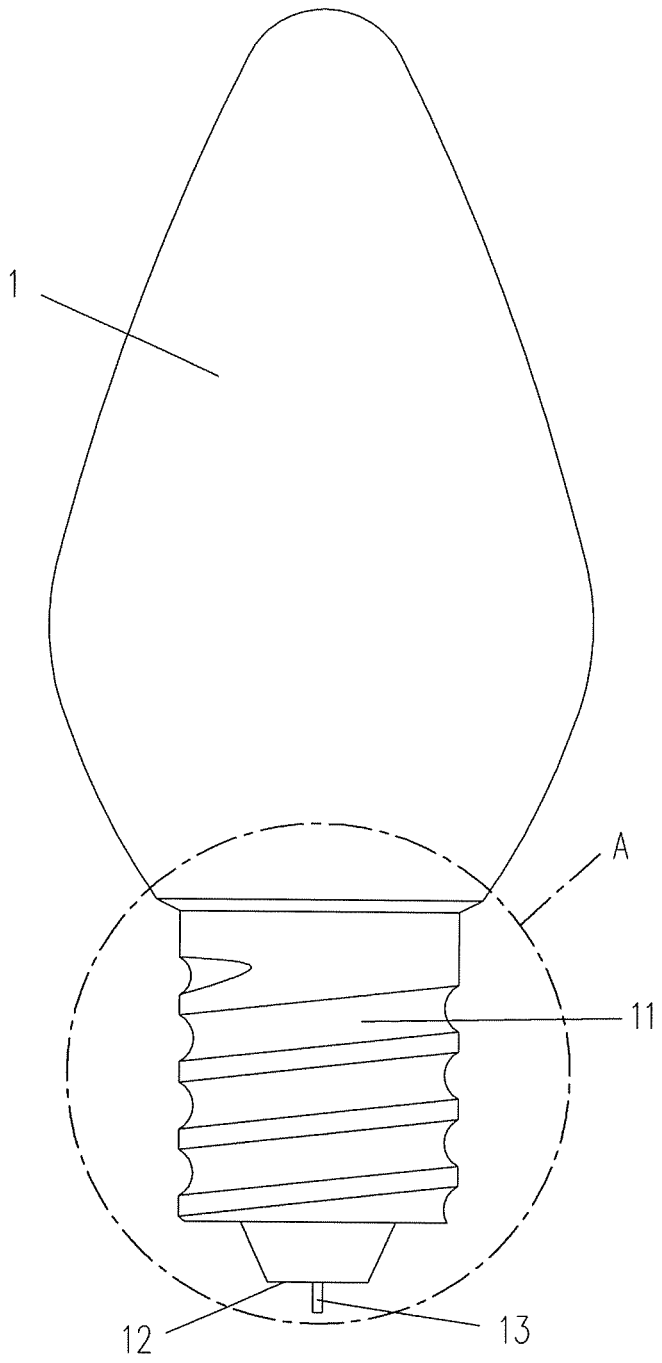
FIG. 1 is a schematic diagram of a three-dimensional structure of the invention.
Figure 2:
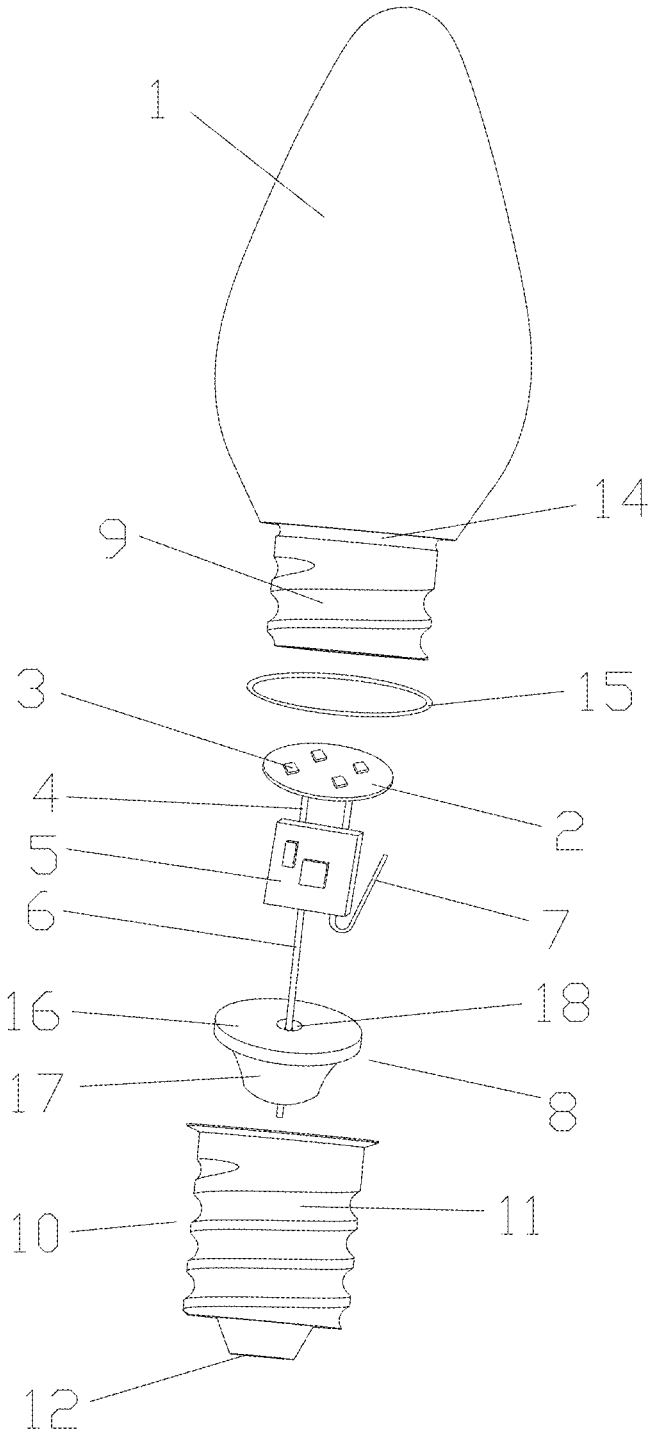
FIG. 2 is a schematic diagram of structural decomposition of the invention.
Figure 3:
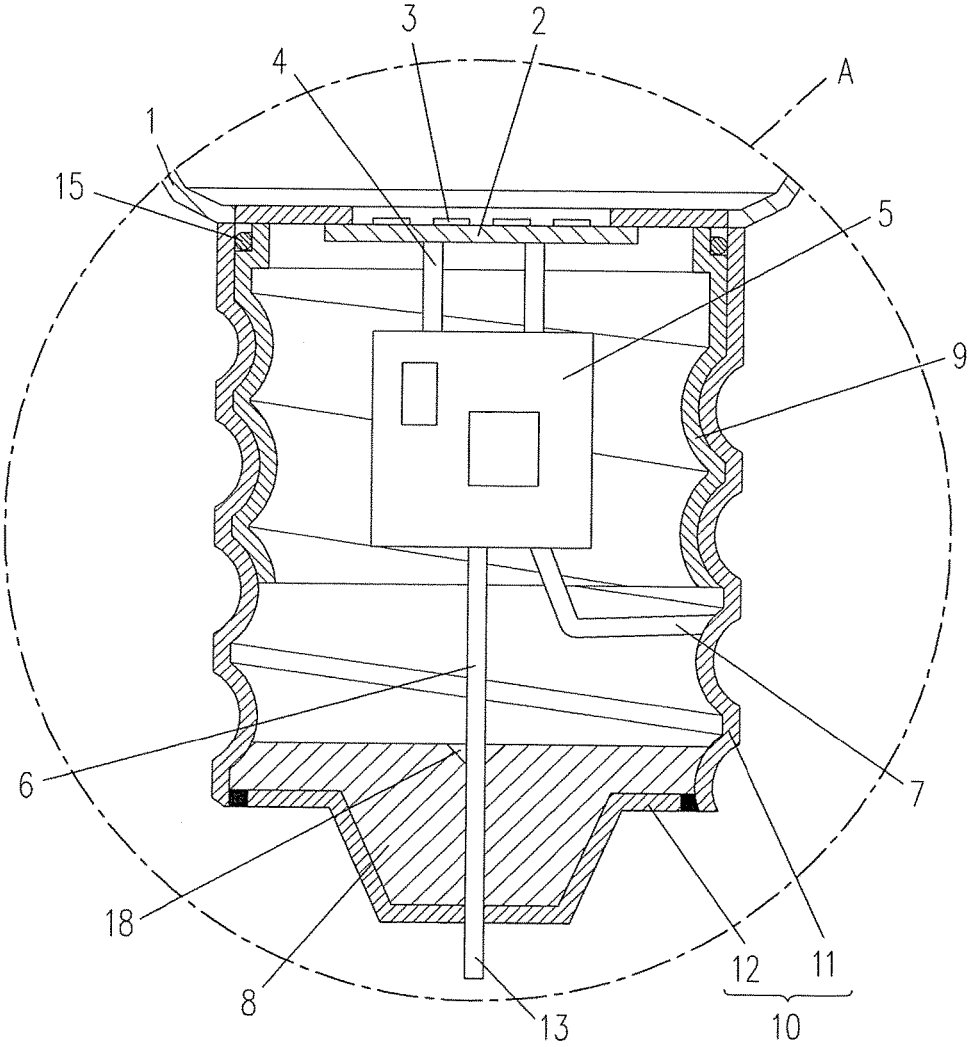
FIG. 3 is a cross sectional view of an internal structure at a region A shown in FIG. 1.

Refer to FIG. 1 and FIG. 2, according to the invention, a waterproof LED decorative bulb comprises a lampshade 1, a horizontal first circuit board 2 horizontally placed at an inner bottom of the lampshade, and a plurality of patch LED luminous bodies 3 arranged on the first circuit board, adopting a patch LED luminous body is beneficial to scattering the light all around so as to enhance the illumination effect, a bottom surface of the first circuit board is connected with two hard vertical conductive pins 4, underneath of the two conductive pins is electrically connected with a vertically placed second circuit board 5, the second circuit board is provided with a patch resistor and an LED driving chip, a lower end of the second circuit board is electrically connected with two electrodes, one of the two electrodes is a hard vertical pin-type electrode 6 and the other thereof is a upward-bending conductive wire 7, underneath of the conductive pin is provided with a silica gel cushion 8, a bottom of the lampshade is provided with an outer threaded connection portion 9 which is in threaded connection with a metal connecting base 10, the first circuit board, the second circuit board and the silica gel cushion are covered and fixed by the metal connecting base between an inner bottom of the lampshade and an inner wall of the metal connecting base as further shown in FIG. 3, a side wall 11 and a bottom 12 of the metal connecting base are a contact electrode respectively, a bottom of the silica gel cushion is fitted with an inner bottom of the metal connecting base, the pin-type electrode pierces through the center of the silica gel cushion and extends out of a through hole at the bottom of the metal connecting base to form an extending portion 13, the extending portion and a contact electrode of the metal connecting base are connected by soldering tin, the conductive wire is contacted with an inner side wall of the metal connecting base, an engagement portion between the lampshade and the outer threaded connecting portion is provided with a waterproof groove 14, and the waterproof groove is internally provided with a waterproof rubber gasket 15. As the bottom of the silica gel cushion is fitted with the inner bottom of the metal connecting base, the bottom of the metal connecting base can realize the waterproof efficiency, and the waterproof groove and the waterproof rubber gasket can realize the waterproof efficiency on the upper opening of the metal connecting base, so that the invention reaches the waterproof efficiency entirely.

A preferred embodiment, the silica gel cushion is provided with a circular table 16, and an outer edge of the circular table is contacted with and compressed with the inner side wall of the metal connecting base as further shown in FIG. 3. The waterproof property is enhanced by threaded connection and compression. The silica gel cushion is provided with a concave bottom 17, and an outer edge of the concave bottom is fitted and contacted with and compressed with the inner side wall of the metal connecting base; similarly, seamless connection is formed through the threaded connection and compression to enhance the waterproof property. the center of an upper surface of the silica gel cushion is provided with a sunken portion 18, the pin-type electrode pierces through the silica gel cushion from the sunken portion, the sunken portion is convenient for piercing, so that it is convenient to assemble and the efficiency is improved. Meanwhile, as silica gel has a heat dissipation property, the silica gel cushion also has the heat dissipation function, which can cool inside electronic elements and LED, so as to ensure and prolong the service lives thereof.

In addition, the invention is not limited to the above implementation manners. Whereas the technical effects of the invention achieved by the almost same means shall all fall within the protection scope of the invention.

What is claimed is:

1. A waterproof LED decorative bulb, comprising a lampshade (1), a horizontal first circuit board (2) horizontally placed at an inner bottom of the lampshade, and a plurality of mounted LED luminous bodies (3) arranged on the first circuit board, wherein a bottom surface of the first circuit board is connected with two hard vertical conductive pins (4), underneath of the two conductive pins is electrically connected with a vertically placed second circuit board (5), the second circuit board is provided with a mounted resistor and an LED driving chip, a lower end of the second circuit board is electrically connected with two electrodes, one of the two electrodes is a hard vertical pin-type electrode (6) and the other thereof is an upward-bending conductive wire (7), underneath of the conductive pins is provided with a silicone cushion (8), a bottom of the lampshade is provided with an outer threaded connection portion (9) which is in threaded connection with a metal connecting base (10), the first circuit board, the second circuit board and the silicone cushion are enclosed within the lampshade and the metal connecting base, an inner bottom of the lampshade and an inner wall of the metal connecting base fix the first circuit board, the second circuit board and the silicone cushion in position therebetween, each of a side wall (11) and a bottom (12) of the metal connecting base is a contact electrode, a bottom of the silicone cushion is fitted with an inner bottom of the metal connecting base, the pin-type electrode pierces through the center of the silicone cushion and extends out of a through hole at the bottom of the metal connecting base to form an extending portion (13), the extending portion and the bottom of the metal connecting base are connected by soldering tin, the conductive wire is contacted with an inner side wall of the metal connecting base, an engagement portion between the lampshade and the outer threaded connection portion is provided with a waterproof groove (14), and the waterproof groove is internally provided with a waterproof rubber gasket (15).

2. The waterproof LED decorative bulb according to claim 1, wherein the silicone cushion is provided with a circular table (16), and an outer edge of the circular table is contacted with and compressed with the inner side wall of the metal connecting base.

3. The waterproof LED decorative bulb according to claim 1, wherein the silicone cushion is provided with a concave bottom (17), and an outer edge of the concave bottom is fitted and contacted with and compressed with the inner side wall of the metal connecting base.

4. The waterproof LED decorative bulb according to claim 1, wherein the center of an upper surface of the silicone cushion is provided with a sunken portion (18), and the pin-type electrode pierces through the silicone cushion from the sunken portion.

* * * * *